US005355595A

United States Patent [19]

Koivukunnas et al.

[11] Patent Number: 5,355,595

[45] Date of Patent: Oct. 18, 1994

[54] STEAM BOX

[75] Inventors: Pekka Koivukunnas, Järvenpää ; Teuvo Lappalainen, Kerava, both of Finland

[73] Assignee: Valmet Paper Machinery, Inc., Helsinki, Finland

[21] Appl. No.: 944,790

[22] Filed: Sep. 14, 1992

[30] Foreign Application Priority Data

Sep. 12, 1991 [FI] Finland ..... 914300

[51] Int. Cl.[5] ..... F26B 13/00

[52] U.S. Cl. ..... 34/570; 34/638; 34/652; 34/654

[58] Field of Search ..... 34/114, 115, 116, 122, 34/123, 54, 155, 160, 156; 162/207

[56] References Cited

U.S. PATENT DOCUMENTS

| | | | |
|---|---|---|---|
| 4,050,630 | 9/1977 | Dupasquier | 34/210 |
| 4,253,247 | 3/1981 | Bergstrom | 34/155 |
| 4,268,976 | 5/1981 | Dove | 34/155 |
| 4,271,602 | 6/1981 | Grolms | 34/160 |
| 4,358,900 | 11/1982 | Dove | 34/160 |
| 4,422,575 | 12/1983 | Dove | 34/155 |
| 4,543,737 | 10/1985 | Boissevain | 34/92 |
| 4,642,164 | 2/1987 | Hanhikoski et al. | 162/207 |
| 4,765,067 | 8/1988 | Taylor | 34/23 |
| 4,945,654 | 8/1990 | Mason | 34/23 |

FOREIGN PATENT DOCUMENTS

0275914A3 7/1988 Fed. Rep. of Germany .

*Primary Examiner*—Denise Gromada

*Attorney, Agent, or Firm*—Cohen, Pontani, Lieberman, Pavane

[57] ABSTRACT

A steam box includes a system for distributing steam onto a web being calendered. At least one valve is connected to the steam distributing system for controlling the flow of steam onto the web. The steam box also has element for feeding hot steam to the valve. Each valve has at least three steam channels, namely an inlet channel for feeding the steam to the valve, an outlet channel of the valve for feeding the steam onto the web and a recirculation channel for recirculating the steam. The valve also has a check element for controlling and dividing the incoming steam flow from the inlet channel between the outlet channel and recirculation channel of the valve, and a return pipe connected to the recirculation channels of the valves, capable of routing the steam directed to the recirculation channel of the valve to e.g., the condensate return line of the steam distributing system. By virtue of such a circulation the valve can be kept warm even when no steam is directed via the valve, thus preventing the formation of droplets and their blowing onto the web.

7 Claims, 3 Drawing Sheets

STEAM BOX

BACKGROUND OF THE INVENTION

1. Field Of the Invention

The present invention relates to a steam box for cross-machine profiled moisturizing and heating of a web of paper. The steam box includes a steam distributing system for distributing the steam onto the web being calendered. At least one valve is connected to the steam distributing system for controlling the flow of steam onto the web. In addition, elements are provided for feeding hot steam to the valve.

2. Description of the Related Art

Paper web gloss after calendering can be improved by heating and moisturizing of the web with steam prior to calendering or between calendering. Moisturizing with steam can be used in conjunction with all calendering methods. The steam is directed onto the web via a steam box. Due to the variations in the properties of the web to be calendered, the steam box is conventionally divided in the cross-machine direction of the web into independently controllable compartments. The compartmentally controllable steam feed can be employed for equalizing the moisture profile of the web and reducing the effect of thickness and texture variations on the smoothness and gloss of the calendered web. The controllable steam feed can also be utilized for removal of one-sidedness of the web texture by moisturizing the coarser side of the web with more steam than the opposite smoother side. The chief goal of steam-treatment is, however, to attain improvement of paper gloss after calendering and homogeneous gloss over the entire web width.

The steam feed necessary for achieving a sufficient gloss on coated paper grades is relatively small, typically 2–10 kg/m/h. For uncoated paper grades the steam feed is greater, i.e., 20–100 kg/m/h. Feeding small amounts of steam onto a fast moving web causes several. problems. Frequently, the steam feed onto the web must be set greater than the absorbing capability of the web. Steam can then leak to the vicinity of the steam feed point, where it can rapidly condense on any cooler surfaces. Such steam leakage is inevitable in all conventional steam boxes. Particularly disadvantageous is the condensation of steam on cooler areas of a web to be calendered and of the calender rolls. This results in excessive moisturization of the web, and consequently, degradation of the web surface quality. Excessive moisture on the web surface causes coat blistering and adherence on the calender rolls. Condensed moisture easily forms droplets, which when reaching the web surface ruin the coat.

In profile-correcting steam applications, the steam feed is compartmentally switched on and off according to the steam requirements. If steam feed is switched off from any compartment or the entire steam box, the great amount of air carried along with the fast moving web quickly cools compartments of the steam box. Consequently, water can easily condense in the box and be directed onto the web when the steam feed is again switched on. Such dripping causes defects on the coated paper web. A corresponding situation occurs when steam is switched on at cold start. Prevention of condensate formation and its subsequent splattering on the web to be coated has been attempted by means of heating the box with steam or electricity and using different types of water collecting channels and water drainage unions mounted to the channels.

U.S. Pat. No. 4,786,569 discloses an apparatus in which excess moisturizing steam is prevented from escaping from the steam box to the surroundings by a suction apparatus. However, while the use of a suction apparatus can prevent the spreading of the steam into the surroundings, its lacking capability of the prevention of condensation in intermittent use causing subsequent formation of droplets makes such an apparatus poorly suited to intermittent use and cross-machine control of the moisture profile of the web.

European Patent Application 0,380,413 describes a steam-feed apparatus in which condensate is prevented from dropping onto the web. This apparatus has an adjustable valve for each steam-blowing compartment, capable of providing flow control for the amount of steam directed onto the web. The steam is routed from the valve into a deflecting header in which its velocity vector is altered, so that any condensate possibly following the steam is separated and can be led away from the steam-feed apparatus. The construction of such an apparatus and its nozzles and deflecting headers in particular is complicated, and due to the structure of the deflecting header, the apparatus must be installed so that steam is directed upward from the nozzles of the deflecting header. Thus, such an apparatus must always be placed below the web, which curtails its applications and makes, e.g., simultaneous two-sided blowing of steam on the web impossible. Application of steam from above the web is frequently needed, particularly in soft-nip calendering. Moreover, prevention of droplets from dropping onto the web has been attempted by way of placing the steam-feed apparatus relatively far from the web. This arrangement, however, results in strong cooling of the steam by the air layer carried along with the web before the steam can impinge on the web, thus causing an inferior heating effect of the steam on the web. Moreover, steam can condense into water as the steam temperature falls, so that the water droplets will be directly blown onto the web, thus ruining the coat.

U.S. Pat. No. 4,945,654 discloses an apparatus in which condensation into droplets is prevented by continuously maintaining the apparatus temperature above 100° C. Steam temperature is elevated sufficiently by means of heater elements placed in the steam-feed chamber of the apparatus. Keeping the apparatus at a sufficiently elevated temperature and heating the steam in the steam-feed chamber consumes large amounts of energy, thus rendering the use of such an apparatus inefficient.

Further, a steam nozzle construction is known in the art resembling the suction nozzles used for drying a paper web. In such an embodiment steam is jetted against the machine direction of the web into a gap between the web and an adjacent plane. The plane and the exit edge of the nozzle are kept warm by the jetted steam, thereby aiming to prevent condensation of the steam into droplets and subsequent landing of droplets onto the web. Such a nozzle structure achieves jetting of the steam onto the web at a close distance and, consequently, effective heat transfer. However, if any nozzle over a web section remains unused for some time, the steam chamber communicating with its nozzle slot can accumulate condensate which is easily jetted onto the web at the restart of the steam-blowing. Moreover, the exit edge of the nozzle has relatively complicated heating arrangements. The amount of blown steam is altered by changing the amount of steam entering the nozzles. Therefore, the steam flow rates in the steam chambers of the nozzles vary.

SUMMARY OF THE INVENTION

It is an object of the present invention to achieve a steam box in which condensate is prevented from reaching the web to be calendered and a good controllability of the steam treatment profile is attained.

The invention is based on the concept of providing each steam-feed controlling valve in the steam box with a steam recirculation channel through which steam is routed to the end of keeping the valve warm and preventing condensation of steam into water.

More specifically, in the steam box in accordance with the invention, each valve has at least three steam channels, to wit, an inlet channel for feeding the steam to the valve, an outlet channel of the valve for feeding the steam onto the web, and a recirculation channel for recirculating the steam. A check element controls and divides the incoming steam flow from the inlet channel between the outlet channel and the recirculation channel of the valve. A return pipe is connected to the recirculation channels of the valves for conducting the steam directed to the recirculation channel of the valve, for example, to a condensate return line of the steam distributing system.

The invention provides significant advantages.

The present apparatus permits the interface of the hot steam with the cooled steam to be placed close to the point where steam is directed onto the web. Consequently, the apparatus does not develop a cool area when steam-blowing is controlled off, and thus, the steam cannot condense into droplets. Steam circulating via the re-circulation channel keeps the valve hot during standby and blows away any condensate potentially formed into the valve. Condensation into the valve and the steam feed channels is thus prevented by virtue of the recirculation principle and elimination of cool areas. Consequently, the occurrence of droplet formation so common with steam boxes at the start of steam-blowing is avoided. Prevention of droplet formation is mandatory in profile-controlled steam-blowing because of the frequent opening and closing of valves in adjacent compartments of the steam box for the purpose of achieving a desired moisture profile of the web. The start of steam-blowing in any compartment must take place without delay to obtain good controllability of the moisture profile and sufficiently rapid response to changes in the web properties.

The steam box according to the present invention makes it possible to place several valves in parallel with different volumetric control ranges. Such a construction provides a wide control range of the steam blown onto the web. The different control ranges are advantageously covered by separate valves because if a small volumetric flow is attempted to be blown via a large-capacity valve, the flow velocity might remain small and the impact of the steam on the web would be ineffective. The slowly flowing steam would in such a situation cool prior to hitting the web, whereby a portion of the steam would condense into water, thus ruining the web surface. The present apparatus has an additional benefit in that its construction permits mounting both above and below the web, thus permitting close alignment of the steaming zones on opposite sides of the web, whereby the web properties on both sides of the web are easy to keep identical. The steam box can be mounted close to the web, resulting in effective transfer of heat and moisture. The steam box according to the invention is designed so that sideways blowing of steam is substantially reduced, so that energy losses remain small and unnecessary increase of ambient temperature and humidity is avoided.

BRIEF DESCRIPTION OF THE DRAWING In the Drawing.

DESCRIPTION OF THE PREFERRED EMBODIMENTS

Figure 1:
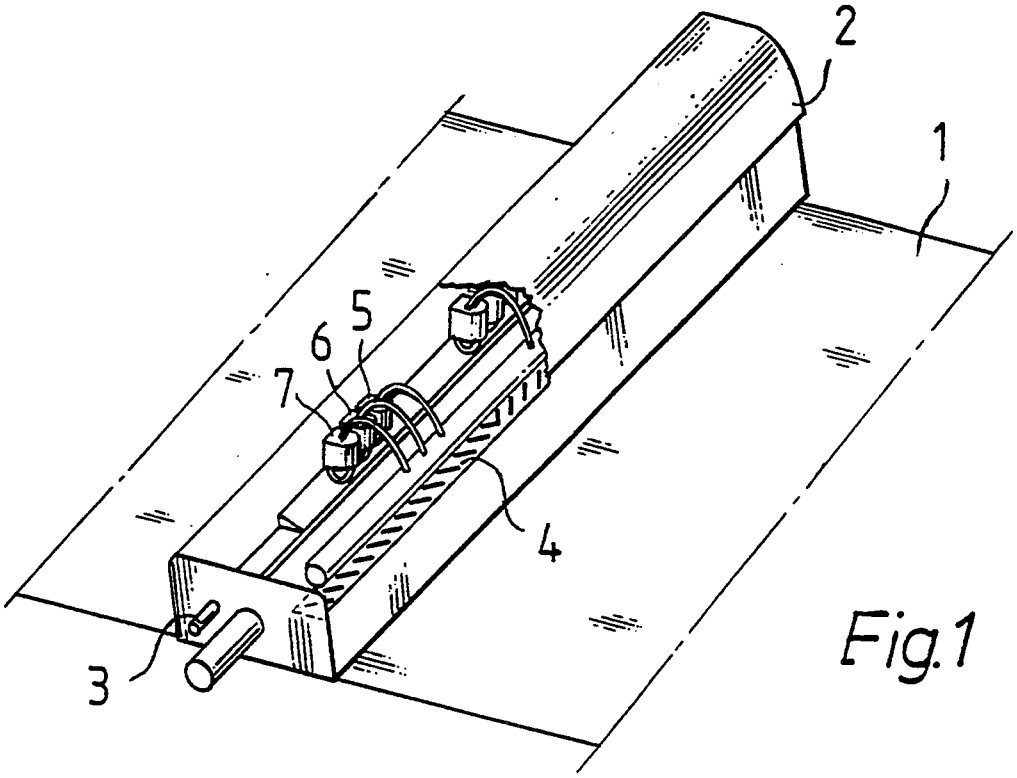
FIG. 1 is a perspective view of the steam box according to the invention.

The steam box can be mounted below the paper web 1, or alternatively, above the web, as shown in FIG. 1. The box is enclosed by a shell structure 2 housing the components of the steam box. Steam is fed into the box via a feed pipe 3, and the amount of steam hitting the web 1 is controlled by valves 5, 6, 7. The steam is directed onto the web 1 through a distribution grille 4. The valves 5, 6, 7 are divided into groups of three valves. Each group has three valves of different size, and each controlled compartment along the longitudinal axis of the steam box is provided with one valve group. The use of valves of different size provides a wide control range of steam flow. The inertial energy of the steam directed at the web 1 must be sufficiently high to doctor away from the surface of the web 1 the air layer carried along with the web 1, after which the steam can effectively heat the web. At low volumetric flow rates (2–20 kg/m/h), the speed of the steam in a large-bore valve remains so low that no steam can reach the web 1. The use of a smaller-bore valve keeps the inertial energy of the steam flow sufficiently high even at low volumetric flow rates.

Figure 2:
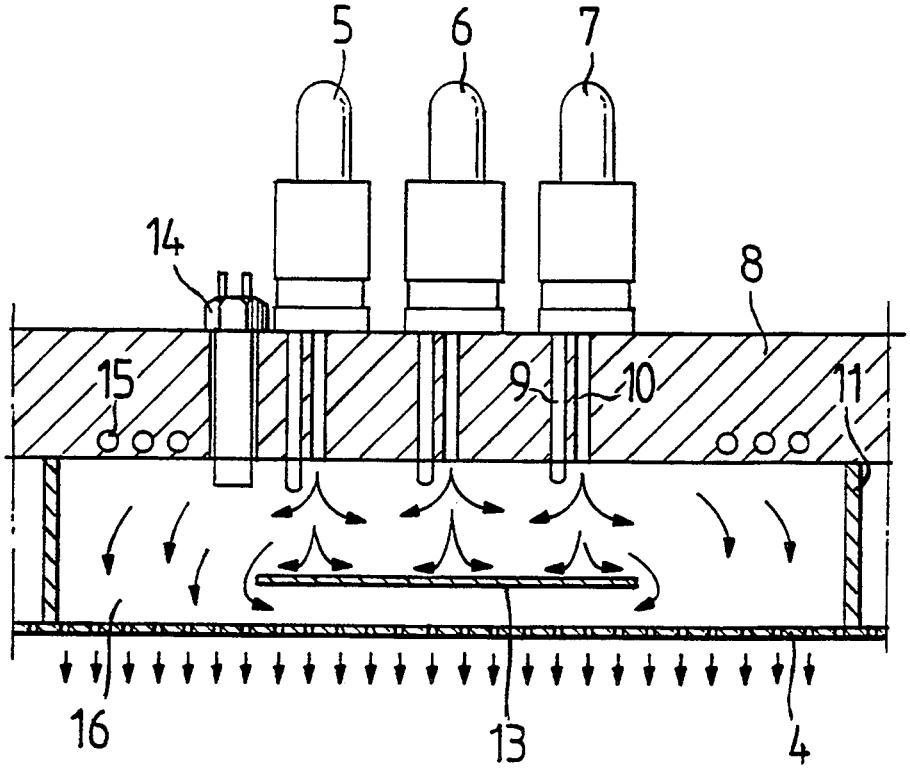
FIG. 2 is a partial sectional view, on a larger scale, of the steam box illustrated in FIG. 1.

FIG. 2 shows in a longitudinally sectional view one controlled compartment of the steam box illustrated in FIG. 1. The valves 5, 6, 7 are mounted on a support beam 8, which also contains the steam-blowing ducts 10. The steam-blowing ducts 10 exit into a steam-blowing space 16 delineated by the support beam 8, intermediate walls 11 and a slotted distribution grille. Opposite to the opening point of the ducts 10, adapted at a distance apart is an equalizing plate 13 on which the steam jet from the steam-blowing ducts 10 impinges. The equalizing plate 13 distributes the steam jet over the area of the controlled compartment and prevents water droplets potentially still remaining in the jet from being blown onto the web 1.

Steam temperature in the steam-blowing space 16 is monitored by means of a sensor 14. The support beam 8 has further channels 9 and 15, whose function will be described below.

Figure 3:
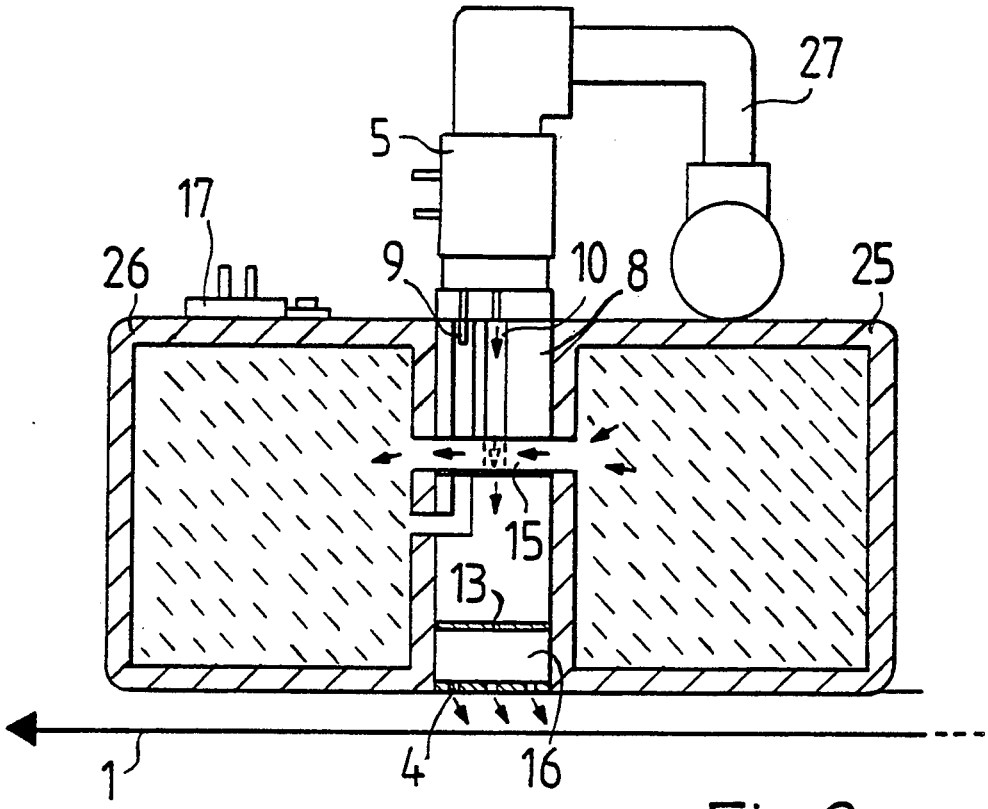
FIG. 3 is a cross-sectional view of the box illustrated in FIG. 2.

FIG. 3 shows the arrangement of steam circulation channels in the steam box. Steam chambers 25 and 26 are adapted to both sides of the steam-blowing space 16. These chambers 25, 26 are connected by a communicating channel 15. The first steam chamber 25 has a steam-feed pipe 3 connected to it. The opposite steam chamber 26 has a steam inlet pipe 9 routed to the valve 5, and the upper end of the valve 5 has a steam return pipe 27 via which the steam used for heating the valves is recirculated back to the condensate return line. The steam-blowing duct 10 from the valve 5 exits into the steam-blowing space 16. When pressurized steam is fed via the steam-feed pipe 3 to the first steam chamber 25, the chamber is heated. As the steam flows further to the second chamber 26, also this chamber is heated. Thus, the surfaces on both sides of the steam-blowing space 16 and the side facing the web 1 are kept continuously warm, so that no condensation can occur on these surfaces, and the temperature of the steam-blowing space 16 is continuously maintained approximately equal to that of the steam chambers 25, 26.

Figure 4:
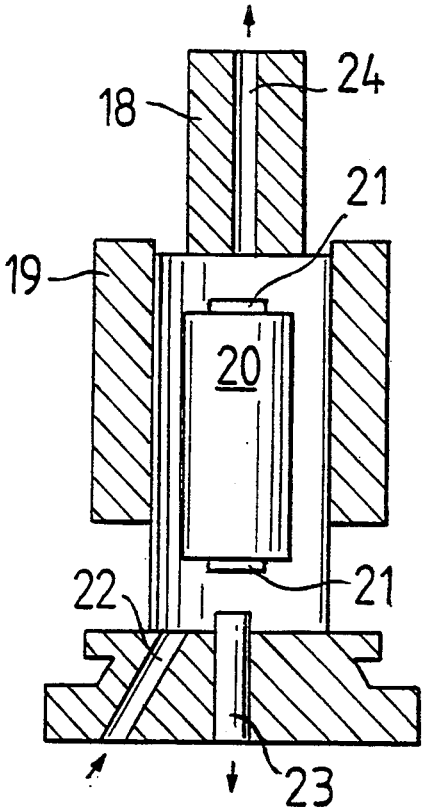
FIG. 4 is a longitudinal sectional view of the three-way valve employed in the steam box according to the invention.

From the second chamber 26 the steam flows to the steam inlet pipe 9 of the valve 5. This valve is a three-way valve, whose one possible embodiment is illustrated in FIG. 4. The valve has a flow chamber having three channels 22, 23 and 24 connected to it. The inlet channel 22 is connected to the steam inlet pipe 9 of the valve in the steam box. The outlet channel 23 of the valve is connected to the steam-blowing duct 10, and the recirculation channel 24 is connected via a connecting piece 18 to the condensate return pipe 27. The flow chamber of the valve incorporates a check element 20 having seals 21 at its both ends. The valve is electrically actuated by means of a solenoid 19. When it is necessary to apply steam through any compartment onto the web 1, the check element 20 is driven against the seated opening of the recirculation channel 24 and the seal 21 closes the recirculation channel 24. Then, the steam entering the inlet channel 22 of the valve through the steam inlet pipe 9 is directed via the flow chamber of the valve along the outlet channel 23 of the valve to the steam-blowing duct 10. If the steam flow is desired to be cut off, the check element 20 is driven against the seated opening of the outlet channel 23, so that the steam can flow from the inlet channel 22 via the flow chamber of the valve to the recirculation channel 24 and further to the condensate return pipe 27. Thus, the hot steam is routed via the steam circulation of the entire steam box and returned to the condensate return line of the steam supply system.

Because the steam flows continuously through the entire steam circulation system of the apparatus, all components touching the steam are maintained hot and no condensation can occur in the channels and chambers of the apparatus. Continuous flow of steam in the valve 5 is particularly important. In conventional valve systems steam is prevented from flowing through a closed valve and the stationary steam will condense even if the valve is kept relatively warm. Then, water condensed in the valve will be blown at the opening of the valve onto the web 1, thus ruining the web surface.

Because each controlled compartment of the steam box has several valves, the number of which in the illustrated embodiment being three 5, 6, 7, the steam is circulated through the other valves when one of the valves is switched on. The use of multiple control valves was impossible in the past due to the accumulation of condensate in a closed valve.

Figure 5:
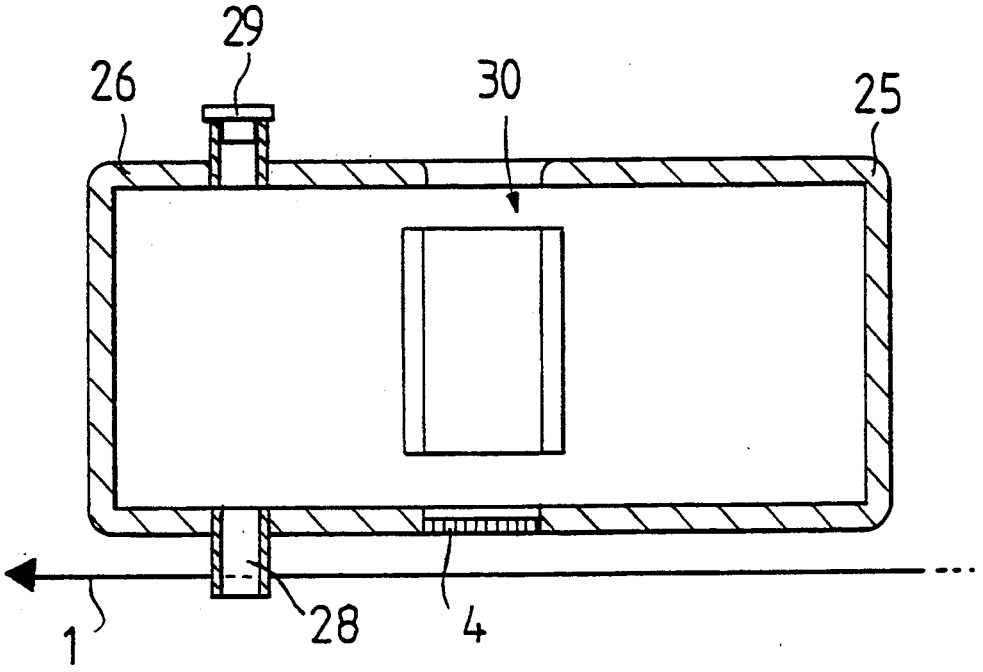
FIG. 5 is a cross-sectional view showing the end of the steam box illustrated in FIG. 1.

FIG. 5 shows the condensate removal system of the steam chambers 25 and 26. The ends of one chamber, here the chamber 26, are provided with two condensate outlets 28. One of the outlets is used for condensate removal, while the other is respectively stoppered by a plug 29. Which one of the outlets is chosen for use depends on whether the steam box is mounted above or below the web. The steam chambers 25 and 26 are connected by communicating channels 30 placed to the ends of the steam box, so that water possibly condensing in the chambers can flow to the condensate removal outlets 28. The outlets 28 are placed close to the ends of the steam box, on that part of the box wall which extends outside the web. Alternative methods of condensate removal are also possible, e.g., by placing the condensate removal outlets to the ends of the steam box.

In addition to the preferred embodiment described above, the invention can have alternative embodiments.

The construction and number of the steam valves can be varied according to local requirements. The valve must, however, be at least of a three-way construction to facilitate the return circulation of steam while the steam outlet channel is closed. An alternative feasible construction uses a proportional valve as the control valve, so that the relative proportions of the steam blown onto the web and the steam recirculated to the condensate return line can be varied, thus maintaining steam recirculation while also directing steam at the web. This arrangement permits the use of increased flow rate of circulating steam, so that it becomes possible to keep the steam box hotter with the help of the greater amount of steam circulated. The apparatus can also be constructed with a number of steam-blowing compartments arranged in succession also in the web direction. Such a steam box can have, e.g., three steam chambers in succession with two steam-blowing spaces between the chambers.

The structure and placement of the steam piping and ducting and the chambers can be varied for the steam box according to the invention. However, the end of the inlet pipe feeding the steam to the valve may not be placed too close to the upper or lower part of the steam chamber to avoid the condensate possibly forming in the chamber from reaching the valve. An advantageous placement is approximately at the midpoint of the chamber wall, so that the steam box can be mounted without structural changes alternatively above or below the web. In addition to or instead of feeding the steam to the first steam chamber, the hot steam can be fed to other parts of the steam circulation system of the apparatus, e.g., directly to the valve or the second steam chamber.

What is claimed is:

1. A steam box for moisturizing a web, comprising: steam distributing means for distributing a flow of steam onto a web being calendered; at least one valve being connected to the steam distributing means for controlling the flow of steam onto a web; and means for feeding hot steam to the valve, each valve having at least a first, a second and a third steam channel, the first steam channel being an inlet channel for feeding the steam to the valve, the second channel being an outlet channel for conducting the steam to the web, and the third channel being a recirculation channel for recirculating the steam, each valve further comprising a check element movably mounted in the valve for controlling and dividing the steam introduced into the valve through the inlet channel between the outlet channel and the recirculation channel, the steam box further comprising a return pipe connected to the recirculation channel of the at least one valve for conducting the steam introduced to the recirculation channel to a condensate return line of the steam distributing means.

2. The steam box according to claim 1, comprising a steam-blowing space extending along a longitudinal axis of the steam box, the steam blowing space being divided into compartments over the longitudinal axis of the box, the steam blowing space having at least one partially open side, each compartment being in communication with at least three valves, further comprising steam-blowing ducts for connecting the outlet channel of each valve to the steam-blowing space.

3. The steam box according to claim 2, comprising at least a first and a second steam chamber, each steam chamber having upper and lower walls and a side wall extending between the upper and lower side walls, the side walls of the first and second steam chambers forming the steam-blowing space there between, wherein another wall of each chamber is oriented toward the web.

4. The steam box according to claim 3, wherein the feeding means comprises a steam inlet pipe connected to the first steam chamber, at least one communicating channel connecting the first steam chamber with the second steam chamber, and additional inlet pipes connecting the second steam chamber to the inlet channel of the valve, the recirculation channel of the valve being connected through the return pipe, wherein the steam blowing duct connects the outlet channel of the valve to the steam-blowing space, so that each valve can be controlled so as to direct the steam either onto the web or through the valves back to the return pipe.

5. The steam box according to claim 4, wherein the communicating channels between the steam chambers have openings into the steam chambers, the openings being spaced vertically from the upper and lower walls of the second steam chamber.

6. The steam box according to claim 4, wherein the additional inlet pipe of each valve has an inlet opening, the inlet opening being spaced at a distance from the upper and lower walls of the second steam chamber.

7. The steam box according to claim 3, comprising three steam chambers arranged next to each other and to steam blowing spaces between the steam chambers.

* * * * *